US010507996B2

(12) United States Patent
Wimmer

(10) Patent No.: US 10,507,996 B2
(45) Date of Patent: Dec. 17, 2019

(54) SUPPLY ROLL WITH FUNCTIONAL MARKER, METHOD FOR HANDLING FLAT MATERIAL AND/OR STRIP MATERIAL WOUND ONTO SUPPLY ROLLS, AS WELL AS SYSTEM FOR HANDLING FLAT MATERIAL AND/OR STRIP MATERIAL

(71) Applicant: Krones Aktiengesellschaft, Neutraubling (DE)

(72) Inventor: Thomas Wimmer, Rosenheim (DE)

(73) Assignee: Krones Aktiengesellschaft, Neutraubling (DE)

( * ) Notice: Subject to any disclaimer, the term of this patent is extended or adjusted under 35 U.S.C. 154(b) by 44 days.

(21) Appl. No.: 15/569,141

(22) PCT Filed: Apr. 14, 2016

(86) PCT No.: PCT/EP2016/058222
§ 371 (c)(1),
(2) Date: Oct. 25, 2017

(87) PCT Pub. No.: WO2016/173857
PCT Pub. Date: Nov. 3, 2016

(65) Prior Publication Data

US 2018/0155143 A1 Jun. 7, 2018

(30) Foreign Application Priority Data

Apr. 30, 2015 (DE) ..... 10 2015 208 126

(51) Int. Cl.
*B65H 19/18* (2006.01)
*B65H 19/10* (2006.01)
*B65H 19/12* (2006.01)

(52) U.S. Cl.
CPC ..... *B65H 19/18* (2013.01); *B65H 19/102* (2013.01); *B65H 19/105* (2013.01);
(Continued)

(58) Field of Classification Search
CPC .... B65H 19/18; B65H 19/105; B65H 19/123; B65H 19/1873; B65H 19/102;
(Continued)

(56) References Cited

U.S. PATENT DOCUMENTS 2,320,656 A 6/1943 Roesen
4,238,261 A * 12/1980 Tetro ..... B65H 19/102 156/157
(Continued)

FOREIGN PATENT DOCUMENTS

CN 102275764 A 12/2011
DE 19522110 1/1997
(Continued)

OTHER PUBLICATIONS

German Application No. DE 10 2015 208 126.5, Filed: Apr. 30, 2015; German Search Report dated Dec. 9, 2015.
(Continued)

*Primary Examiner* — William A. Rivera
(74) *Attorney, Agent, or Firm* — Simmons Perrine Moyer Bergman PLC

(57) ABSTRACT

The disclosed supply roll (5) comprises a roll core (6); flat material and/or strip material (8) being carried on the roll core (6) in a multitude of windings; and at least one functional marker (2). The at least one functional marker (2) is placed in a specified relative position at an externally arranged free end section (7) of the flat material and/or strip material (8) such that information about the relative position of the free end section (7) is optically identifiable by way of the at least one functional marker (2).

13 Claims, 6 Drawing Sheets

(52) U.S. Cl.
CPC ..... *B65H 19/123* (2013.01); *B65H 19/1873* (2013.01); *B65H 2301/4175* (2013.01); *B65H 2301/41764* (2013.01); *B65H 2301/46115* (2013.01); *B65H 2511/212* (2013.01); *B65H 2553/42* (2013.01); *B65H 2553/52* (2013.01); *B65H 2701/1241* (2013.01); *B65H 2701/1244* (2013.01); *B65H 2701/12422* (2013.01); *B65H 2701/1842* (2013.01); *B65H 2701/1944* (2013.01); *B65H 2801/81* (2013.01)

(58) Field of Classification Search
CPC ..... B65H 2301/41764; B65H 2301/46115; B65H 2701/12422; B65H 2701/1244; B65H 2553/42; B65H 2511/212; B65H 2701/1241; B65H 2301/4175; B65H 2701/1944; B65H 2801/81; B65H 2701/1842; B65H 2553/52
See application file for complete search history.

(56) References Cited

U.S. PATENT DOCUMENTS

| | | | | |
|---|---|---|---|---|
| 4,840,320 | A | 6/1989 | Shigeta et al. | |
| 4,948,060 | A | 8/1990 | Kurz et al. | |
| 5,167,376 | A | 12/1992 | Boldrini et al. | |
| 5,683,807 | A * | 11/1997 | Roder | B65H 19/102 242/556 |
| 5,795,432 | A | 8/1998 | Urban | |
| 5,857,391 | A * | 1/1999 | Renstrom | B65B 69/0033 414/25 |
| 6,155,516 | A * | 12/2000 | Lehrieder | B65H 19/12 242/559.3 |
| 6,168,842 | B1 * | 1/2001 | Thoma | B65H 19/102 242/556.1 |
| 6,453,808 | B1 | 9/2002 | Nieminen et al. | |
| 6,533,212 | B1 * | 3/2003 | Tafel, II | B65H 19/1815 242/554.6 |
| 6,666,249 | B2 | 12/2003 | White | |
| 9,415,942 | B2 * | 8/2016 | Ishimatsu | H01M 10/0409 |
| 9,573,713 | B2 | 2/2017 | Huber et al. | |
| 2001/0054642 | A1 | 12/2001 | Landolt et al. | |
| 2014/0057769 | A1 | 2/2014 | Steinemann et al. | |

FOREIGN PATENT DOCUMENTS

| | | |
|---|---|---|
| EP | 2388219 | 11/2011 |
| GB | 915287 A | 1/1963 |
| GB | 2161795 | 1/1986 |

OTHER PUBLICATIONS

PCT Application No. PCT/EP2016/058222, Filed Apr. 14, 2016; International Search Report dated Jul. 12, 2016.
PCT/EP2016/05822—PCT Written Opinion of the International Search Authority dated Jul. 12, 2016—English Translation.
Corresponding Chinese Patent Application—First Office Action dated Nov. 26, 2018.

* cited by examiner

SUPPLY ROLL WITH FUNCTIONAL MARKER, METHOD FOR HANDLING FLAT MATERIAL AND/OR STRIP MATERIAL WOUND ONTO SUPPLY ROLLS, AS WELL AS SYSTEM FOR HANDLING FLAT MATERIAL AND/OR STRIP MATERIAL

CLAIM OF PRIORITY

The present application is a national stage application of International Application PCT/EP2016/058222, filed on Apr. 14, 2016, which in turn claims priority to German Application DE 10 2015 208 126.5, filed on Apr. 30, 2015, all of which are incorporated by reference.

FIELD OF THE INVENTION

The present invention relates to a supply roll with a roll core and flat material and/or strip material being carried on the roll core in a multitude of windings.

BACKGROUND OF THE INVENTION

Such like supply rolls can be used in the area of packaging technology, for example. Apparatuses are known that provide flat material and/or strip material interruption-free for wrapping and, in doing so, assembling articles with the flat material and/or strip material. The flat material and/or strip material can be formed, for example, as shrink film, with a plurality of beverage containers being wrapped with the shrink film and being assembled in bundles.

If the supply of flat material and/or strip material on a roll is exhausted, the roll has to be replaced with a further roll of new flat material and/or strip material in order to be able to continue a packaging process and preferentially perform it interruption-free.

Apparatuses for an interruption-free packing process, as well as corresponding supply rolls such as can be used in an interruption-free packing process, are known from DE 195 22 110 A1, for example. The apparatus known from the DE application provides two parallel-mounted shafts on which supply rolls are positioned. Shrink film is unwound from the supply rolls and placed around articles. The articles are subsequently passed through a shrink tunnel. When the supply of shrink film on a roll is exhausted, shrink film from a further roll is affixed to the strip supply of the first roll by heat-sealing.

If the shrink films of two rolls are to be connected by heat-sealing, a free end section of a new roll has to be extracted first and moved toward the other roll for the purpose of heat-sealing. The position of the free end section is frequently unknown so that the new roll first has to be manually rotated or, as the case may be, oriented, whereupon the free end section is moved toward the other roll in order to heat-seal the free end section to shrink film on the other roll. Carrying out this process in an automated manner can lead to problems, while manual aligning is cumbersome and involves personnel input.

SUMMARY OF THE INVENTION

The object of the invention is therefore to provide a supply roll that allows replacing an already depleted supply roll in a simplified manner and there while avoiding problems. An object of the invention is furthermore to provide an at least partly automated apparatus and, accordingly, a method for handling flat material and/or strip material, by which apparatus and method supply rolls can be replaced in a simplified manner, while at least largely avoiding problems.

The above objects are fulfilled by a supply roll, a method, and an apparatus comprising the features in the independent claims. Further advantageous embodiments of the invention are described in the dependent claims.

The present invention relates to a supply roll comprising a roll core, as well as comprising flat material and/or strip material that is carried on the roll core in a multitude of windings. The roll core can be formed from cellulose or plastic, for example, and it can have a hollow cylindrical design. If the supply roll is being used in the area of packaging technology, the flat material and/or strip material can take the form of shrink film or stretch film, for example.

The supply roll moreover has at least one functional marker, which is placed at an externally arranged free end section of the flat material and/or strip material such that information about the relative position of the free end section is optically identifiable by way of the at least one functional marker. The functional marker can be designed as adhesive marker or as sticker and thus potentially comprise an adhesive application applied proportionately or completely at least to one broadside surface. Thus, an adhesive bond can be formed between the at least one functional marker and the externally arranged free end section.

The invention is not limited to embodiments with only one functional marker. It is moreover conceivable for two or more functional markers to be provided in various embodiments, with the functional markers in each case being placed in specified relative position at the free end section of the flat material and/or strip material on a supply roll.

Since the at least one functional marker is placed in specified relative position on the externally arranged free end section of the flat material and/or strip material, it is possible to draw conclusions as to the actual position or, as the case may be, as to the actual alignment of the free end section by an optical identification.

In particularly preferred embodiments, it can be additionally provided that the at least one functional marker comprises one or more adhesive markers, with a particular adhesive bond existing between the one or more adhesive markers and the free end section of the flat material and/or strip material. It is furthermore possible that the supply roll comprises at least one adhesive bond, which fastens the free end section of the flat material and/or strip material to an externally arranged layer of flat material and/or strip material adjacent to the free end section. In this context, it can be the particular adhesive bond of the adhesive marker that can fasten the free end section of the flat material and/or strip material to the externally arranged layer of flat material and/or strip material adjacent to the free end section. The adhesive marker or, as the case may be, the sticker can thus be glued to both the free end section and to the externally arranged layer of the flat material and/or strip material. If there is more than one adhesive marker present, then it is possible that all adhesive markers of the particular supply roll fasten the free end section to an externally arranged layer of flat material and/or strip material adjacent to the free end section. The free end section can advantageously maintain its relative position on the roll by way of the glued bond. The risk of unintentional unwinding of flat material and/or film material from the supply roll is thus reduced.

It is also conceivable, however, that the free end section itself is glued to the layer of flat material and/or strip material adjacent to the free end section. At least one adhesive bond can thus be intermediately disposed between the side of the free end section facing toward the adjacent layer and the adjacent layer.

It is moreover conceivable that the adhesive marker or a broadside surface of the adhesive marker decreases in planar extension toward the externally arranged layer such that the bond between the externally arranged layer and the adhesive marker has less adhesive force than the bond between the free end section and the adhesive marker. In particular, the adhesive marker can taper toward the externally arranged layer. In this context, embodiments have proven successful in which the adhesive marker has two oppositely located broadside surfaces having a triangular design, and one of them being formed as adhesive surface. Advantageously, the free end section can in this context simply be extracted, with the bond between the adhesive marker and the adjacent externally arranged layer being undone and the bond between the adhesive marker and the free end section being maintained.

It is also possible that at least one functional marker has at least one first mark assigning to the functional marker a specific rotary position with regard to the end edge of the externally arranged free section. The at least one mark can in this context comprise a transparent and preferably straight-lined window, for example, through which the run of the end edge of the externally arranged free end section can be optically identified. Practice has shown that functional markers, in particular if they are designed as adhesive marker, can also be applied manually onto the free end section. It is moreover possible to carry out the attaching or forming of the functional marker on the free end section in an automated manner.

Other marks or, as the case may be, other optical marks, can also be taken into consideration in order to assign to the at least one functional marker a specific rotary position with regard to the end edge of the externally arranged free end section, where required. Symbols, for example, can be provided, such as an arrow-based illustration, or the like, indicating, with the help of the end edge, the corresponding specific rotary position for the at least one functional marker.

At least one functional marker can moreover have at least one second mark, which assigns to the at least one functional marker a center position with regard to the longitudinal extension of the supply roll. In this context, a marking preferably along the path of a winding and halfway into the longitudinal extension can be applied onto the supply roll or, as the case may be, onto the flat material and/or strip material. The at least one functional marker can then be applied onto the free end section of the flat material and/or strip material of the supply roll at least approximately centrally with the help of the mark. A transparent window can be provided as mark for assigning the center position to the functional marker. Here, it is also possible for symbols to be provided, such as an arrow-based illustration or the like, which with the help of the marking indicates the corresponding center position for the at least one functional marker.

In this instance, too, the supply roll can comprise an RFID transponder on which information about the supply roll is stored. Information on the number of windings, on the type of the particular flat material and/or strip material, on the amount of the longitudinal extension of the supply roll and/or other information, can for example be stored on the RFID transponder. The information can then be read from the RFID transponder by way of a corresponding RFID reader and can be shown on a display and/or used for working parameters of the packaging machine, if applicable. The RFID reader can be disposed in the area of an installation position for the supply roll or, as the case may be, in the area of a retaining mandrel. It is also conceivable for a handling device, which positions the particular supply roll onto a retaining mandrel, to carry the RFID reader.

The RFID transponder can be fixed on the flat material and/or strip material of the particular supply roll and can, for example, be glued onto the flat material and/or strip material of the particular supply roll. In particularly preferred embodiments, the RFID transponder can be designed as component of the functional marker. It is also conceivable for the RFID transponder to be embedded into the free end section of the flat material and/or strip material or, as the case may be, for the flat material and/or strip material to form a pocket in the free end section, which pocket accommodates the RFID transponder.

Generally, it can be advantageous for the functional markers to be equipped and used for transmitting and/or providing information and/or data about the film rolls to a packaging machine and/or to a handling device. Other information carriers to be suitably used can be printed optical encodings or the mentioned RFID transponders.

It is also conceivable that the at least one functional marker has a QR code with the corresponding above-mentioned information about the supply roll in encoded form. Beyond these, other encodings are also suitable so that information about the supply roll can be recorded, such as barcodes.

In particularly preferred embodiments, at least one functional marker can consist of a print application having been applied in specified relative position onto the free end section. In this instance, the print application can comprise at least one mark placed as line and extending parallel to an end edge of the externally arranged free end section of the flat material and/or strip material. The line can extend proportionately or completely across the entire width of the flat material and/or strip material. The print application can, in particular, be designed such that it indicates a center position with regard to the longitudinal extension of the supply roll. With the help of the print application and its optical detection it is thus possible to determine and, as the case may be, to correct an axial alignment of the supply roll upon mounting it into an installation position, which will be described below, such that the axial alignment of the supply roll in the particular installation position corresponds to a target orientation.

The invention moreover relates to a method for handling flat material and/or strip material wound onto supply rolls. In the context of the method, at least one functional marker is applied in specified relative position onto an externally arranged free end section of the flat material and/or strip material on a supply roll. The at least one functional marker can be placed according to the previous description. Furthermore, the at least one functional marker can comprise an adhesive marker, which is glued onto the free end section of the flat material and/or strip material or, as the case may be, which has an adhesive application by which the adhesive marker is attached to the free end section. Attaching the adhesive marker to the free end section of the flat material and/or strip material can be performed automatedly or manually. The adhesive application can be designed as component of the adhesive marker.

In the context of a further method step temporally following the application of the functional marker onto the free end section, as the case may be, the supply roll is positioned onto a retaining mandrel. It is possible to provide a handling device, for example, that positions the supply roll onto the retaining mandrel. The retaining mandrel can be designed as component of an installation position of a packaging machine and can be rotated or actuator-rotated, as the case may be, for unwinding the flat material and/or strip material from the particular supply roll, as required.

The position of the at least one functional marker is optically identified in a further method step. For this purpose, optical sensors and, for example, one or more camera systems can be provided for optically identifying the position of the at least one functional marker. It is conceivable, for example, that the position of the at least one functional marker is optically identified and the supply roll is subsequently positioned on the retaining mandrel. A handling device can be provided, for example, that has an optical sensor or, as the case may be, a camera system identifying the position of the at least one functional marker and subsequently positioning the supply roll onto the retaining mandrel such that the free end section or, as the case may be, the at least one functional marker has a specific alignment or, as the case may be, a specific position.

It is, however, also conceivable that one or more optical sensors are positioned in the area of the retaining mandrel or, as the case may be, in the area of a particular installation position for the supply roll, and that said optical sensors identify a position of the at least one functional marker after the supply roll is positioned on the retaining mandrel. If the position of the at least one functional marker does not conform to a specified desired position, the retaining mandrel can rotate the supply roll until the position of the at least one functional marker conforms to a specified desired position. The free end section is thus aligned, in a further method step, based on the optical identification. The free end section can be aligned by a rotation of the retaining mandrel on which the particular supply roll is positioned.

Practice has shown that functional markers can be well identified if the functional marker has high-contrast areas on a broadside surface facing away from the supply roll. In this way, at least one first, identifiable area of the at least one functional marker can be designed in black and at least one further area potentially abutting on the first area can be designed in white and/or designed to be transparent.

In a further method step, the free end section is gripped and extracted from the supply roll. A suction device and/or gripping device or, as the case may be, a suction rod, for example, can be provided for this purpose, which takes hold of the free end section via negative pressure and guides the free end section away from the supply roll. Since this step is carried out temporally after the alignment of the at least one functional marker or, as the case may be, of the free end section, the free end section can be taken over by the suction device and/or gripping device and can be extracted away from the particular supply roll in a targeted manner and without problems. In packaging machines, the free end section can subsequently be attached to flat material and/or strip material already passing through the packaging machine and being potentially unwound from a further supply roll of a further installation position. A vertically movable sealing bar, for example, can be provided for this purpose, which moves the free end section against the flat material and/or strip material already being guided in the packaging machine.

It is also conceivable that the at least one functional marker is applied onto the externally arranged free end section at least approximately centrally and/or in a specific rotary position with regard to the end edge of the externally arranged free end section. As already mentioned above, the at least one functional marker can for this purpose have one or more marks for attaching the at least one functional marker to the free end section at least approximately centrally and/or in a specific position or, as the case may be, in a specific rotary position. Embodiments have proved particularly successful in which the at least one mark is formed by a transparent window in a T shape. The at least one mark can moreover serve for verifying a correct location or, as the case may be, a correct specified relative position of the at least one functional marker on the free end section of a particular supply roll.

It is furthermore possible that at least one functional marker is designed as adhesive marker, which is attached and, in particular, glued to a free end section of the flat material and/or strip material and to a layer of the flat material and/or strip material adjacent to the free end section, such that the at least one functional marker or, as the case may be, the at least one adhesive marker fastens the free end section to the adjacent layer of flat material and/or strip material. Embodiments have proved particularly successful in which the adhesive marker is attached to the free end section and to the adjacent layer by way of an adhesive bond such that an adhesive force of the adhesive bond between the free end section and the adhesive marker is formed to be greater than an adhesive force between the adjacent layer and the adhesive marker. In this way, the free end section can simply be extracted from the supply roll or, as the case may be, from the planar strip material, whereas the at least one functional marker or, as the case may be, the at least one adhesive marker remains attached to the free end section.

In particularly preferred embodiments, it can be provided that one or more functional markers are printed in specified relative position onto the free end section. In this instance, a print application can be designed pursuant to above description for conceivable embodiments of the supply roll according to the invention. It is, in particular, possible for a line to be printed onto the free end section, said line running parallel or at least approximately parallel to an end edge of the free end section.

The invention moreover relates to an apparatus for handling flat material and/or strip material wound onto supply rolls. The apparatus comprises a device that can apply the at least one functional marker in specified relative position onto an externally arranged free end section of the flat material and/or strip material on a supply roll. The device can comprise a handling device, for example, that can apply a functional marker designed as adhesive marker onto the externally arranged free end section.

The apparatus, which can be designed as packaging machine if required, moreover comprises at least one, and preferably two installation positions provided for the rotating reception of supply rolls of flat material and/or strip material. The at least one installation position can have a retaining mandrel associated with it, on which the supply roll is positioned. By increasing its cross-sectional diameter, the retaining mandrel can clampingly fix the supply roll, as the case may be.

Moreover provided is a handling device for mounting the particular supply roll into the at least one installation position. A plurality of supply rolls, for example, can be disposed on a pallet, can be taken over by the handling device, and can be mounted into the particular installation position. Prior to the handling device taking over the supply rolls, the free end section of the particular supply roll can already have the at least one functional marker or, as the case may be, the free end section of the particular supply roll can be attached to an adhesive marker.

The apparatus also comprises an optical detection device so that a position of the at least one functional marker can be identified. The optical detection device can comprise at least one camera system, for example.

Furthermore provided is or are one or more devices for aligning the free end section of a particular supply roll based on the optical detection such that the free end section of the particular supply roll in the installation position has a predefined position. The one or more devices can be designed as retaining mandrel, for example, or, as the case may be, they can comprise a retaining mandrel on which the particular supply roll is clampingly positioned. The retaining mandrel can be rotated by a specific distance in order to align the free end section, until the free end section or, as the case may be, the at least one functional marker has reached a desired position.

In preferred embodiments, the apparatus can comprise at least one printing station so that the at least one functional marker can be printed in specified relative position onto the externally arranged free end section of the flat material and/or strip material on a particular supply roll.

BRIEF DESCRIPTION OF THE FIGURES

In the following passages, the attached figures further illustrate exemplary embodiments of the invention and their advantages. The size ratios of the individual elements in the figures do not necessarily reflect the real size ratios. It is to be understood that in some instances various aspects of the invention may be shown exaggerated or enlarged in relation to other elements to facilitate an understanding of the invention.

DETAILED DESCRIPTION OF THE INVENTION

Figure 1:
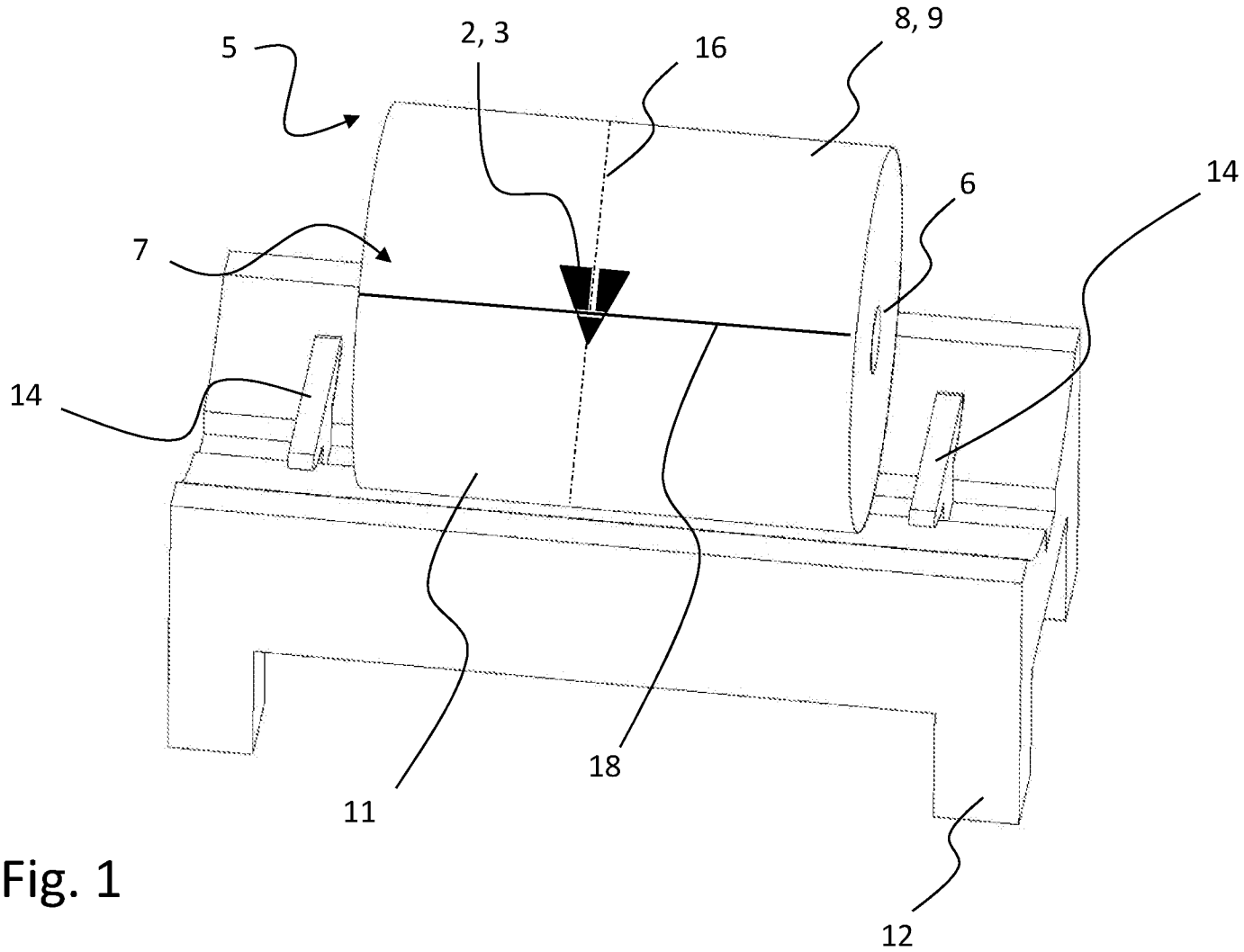
FIG. 1 shows a schematic view of an embodiment of a supply roll according to the invention.

The same or equivalent elements of the invention are designated by identical reference characters. Furthermore and for the sake of clarity, only the reference characters relevant for describing the individual figures are provided. It should be understood that the detailed description and specific examples, while indicating preferred embodiments, are intended for purposes of illustration only and are not intended to limit the scope of the invention.

FIG. 1 shows a schematic view of an embodiment of a supply roll 5 according to the invention. The supply roll 5 has a roll core 6 that can be made of cellulose or plastic, for example, and that is designed as a hollow cylinder. By way of the hollow cylindrical design, the supply roll 5 or, as the case may be, the roll core 6 can be positioned on a retaining mandrel 15 or, as the case may be, can be picked up by a handling device 10 and positioned on a retaining mandrel 15 (cf. FIG. 5).

Flat material and/or strip material 8 in a multitude of windings is carried on the roll core 6. The flat material and/or strip material 8 is shrink film 9.

The supply roll 5 furthermore comprises a functional marker 2, in the present instance designed as adhesive marker 3, which is attached in specified relative position to an externally arranged free end section 7 of the flat material and/or strip material 8 or, as the case may be, of the shrink film 9. If the position of the functional marker 2 is known or, as the case may be, if the position of the functional marker 2 has been identified, it is hereby possible to draw conclusions as to the relative position of the free end section 7.

The supply roll 5 rests on a holding block 12, which limits the freedom of movement of the supply roll 5 on the holding block 12 by way of two lateral stops 14. It is conceivable, for example, that the functional marker 2 or, as the case may be, the adhesive marker 3 is applied onto the supply roll 5 or, as the case may be, onto the free end section 7 of the supply roll 5 while the supply roll 5 rests on the holding block 12. It is also possible that the supply roll 5 is placed onto the holding block 12 and at that point already has a functional marker 2, and that said supply roll 5 is mounted into an installation position EB (cf. FIG. 6) of a packaging machine from the holding block 12.

Figure 2:
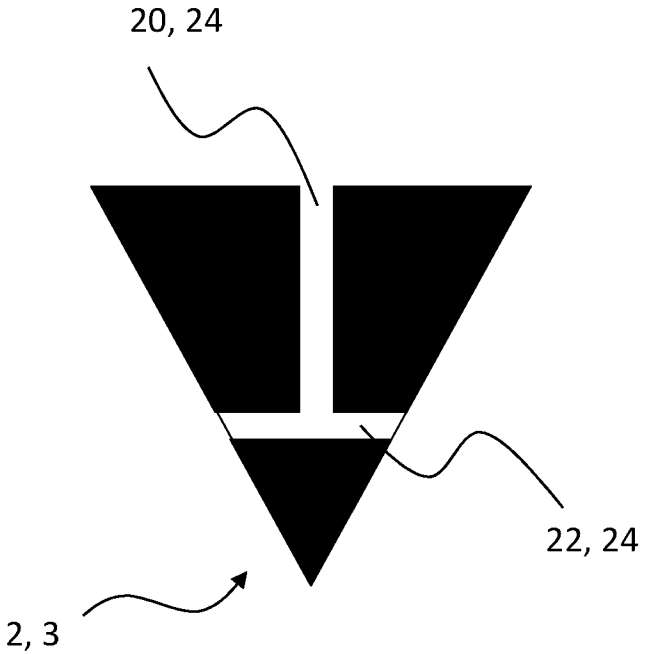
FIG. 2 shows the functional marker of the supply roll of FIG. 1.

The FIGS. 1 and 2 in conjunction illustrate the relative position of the functional marker 2 at the free end section 7 of the flat material and/or strip material 8 or, as the case may be, of the shrink film 9. The functional marker 2 or, as the case may be, the adhesive marker 3 has a first mark 22, which is designed as transparent window 24 and runs in a straight line. The adhesive marker 3 is attached to the free end section 7 of the flat material and/or strip material 8 or, as the case may be, of the shrink film 9 such that an end edge 18 of the free end section 7 extends completely along the mark 22 or, as the case may be, along the transparent window 24. Since the functional marker 2 or, as the case may be, the adhesive marker 3 itself is designed as sticker or, as the case may be, itself forms an adhesive application on its broadside surface facing toward the flat material and/or strip material 8, it is possible to glue the functional marker 2 or, as the case may be, the adhesive marker 3 manually onto the free end section 7 such that the end edge 18 is identifiable through the transparent window 24. After attaching the functional marker 2 or, as the case may be, the adhesive marker 3 to the free end section 7, the transparent window 24 allows a verification with regard to a correct position of the functional marker 2 or, as the case may be, of the adhesive marker 3. If the end edge 18 cannot be identified in the transparent window 24, the functional marker 2 or, as the case may be, the adhesive marker 3 is removed and again attached to the free end section 7, as required.

About halfway into the longitudinal extension of the supply roll 5, a marking 16 is applied along the path of a winding onto the supply roll 5 or, as the case may be, onto the flat material and/or strip material 8. The FIGS. 1 and 2 in conjunction furthermore illustrate a specific positioning of the functional marker 2 or, as the case may be, of the adhesive marker 3 in relation to the marking 16. The functional marker 2 or, as the case may be, the adhesive marker 3 thus has a further, second mark 20 running about vertically or perpendicularly to the mark 22 and likewise being designed as transparent window 24. Both marks 20 and 22 form a T shape. The mark 20 or, as the case may be, the mark 20 designed as transparent window 24 also runs in a straight line. The functional marker 2 or, as the case may be, the adhesive marker 3 is applied onto the free end section 7 or, as the case may be, is linked to the free end section 7 in such a manner that the marking 16 extends along the mark 20 or, as the case may be, along the transparent window 24 of the mark 20. The functional marker 2 or, as the case may be, the adhesive marker 3 is hereby placed about centrally with regard to the longitudinal extension of the supply roll 5 onto the free end section 7 of the supply roll 5. The mark 20 or, as the case may be, the mark 20 designed as transparent window 24 also allows a verification of the correct position of the functional marker 2 or, as the case may be, of the adhesive marker 3 after being attached to the free end section 7. If the marking 16 cannot be identified in the transparent window 24, the functional marker 2 or, as the case may be, the adhesive marker 3 can be removed from the end section 7 and repositioned on the free end section 7 such that the marking 16 extends along the mark 20 or, as the case may be, along the transparent window 24.

If the position of the functional marker 2 or, as the case may be, the adhesive marker 3 is identified, it is hereby possible to draw conclusions as to the position of the free end section 7 and also as to the position or, as the case may be, the dimensions of the supply roll 5. After the optical identification of the functional marker 2 or, as the case may be, of the adhesive marker 3, it is then possible for the free end section 7 to be taken hold of and for the free end section 7 to be extracted from the supply roll 5 without difficulties.

FIG. 1 moreover shows that the functional marker 2 or, as the case may be, the adhesive marker 3 fastens the free end section 7 of the flat material and/or strip material 8 to an externally arranged layer 11 of the flat material and/or strip material 8 that is adjacent to the free end section 7. The functional marker 2 or, as the case may be, the adhesive marker 3 is thus glued both onto the free end section 7 and onto the externally arranged layer 11 such that the free end section 7 or, as the case may be, the flat material and/or strip material 8 cannot be unintentionally unwound. By way of the triangular design of the functional marker 2 or, as the case may be, of the adhesive marker 3, the adhesive force formed between the free end section 7 and the functional marker 2 or, as the case may be, the adhesive marker 3 is greater than an adhesive force formed between the externally arranged layer 11 and the functional marker 2 or, as the case may be, the adhesive marker 3. The free end section 7 can thus simply be extracted, with the adhesive bond between the functional marker 2 or, as the case may be, the adhesive marker 3 and the externally arranged layer 11 being undone, whereas the functional marker 2 or, as the case may be, the adhesive marker 3 remains attached to the free end section 7 of the flat material and/or strip material 8.

Figure 3:
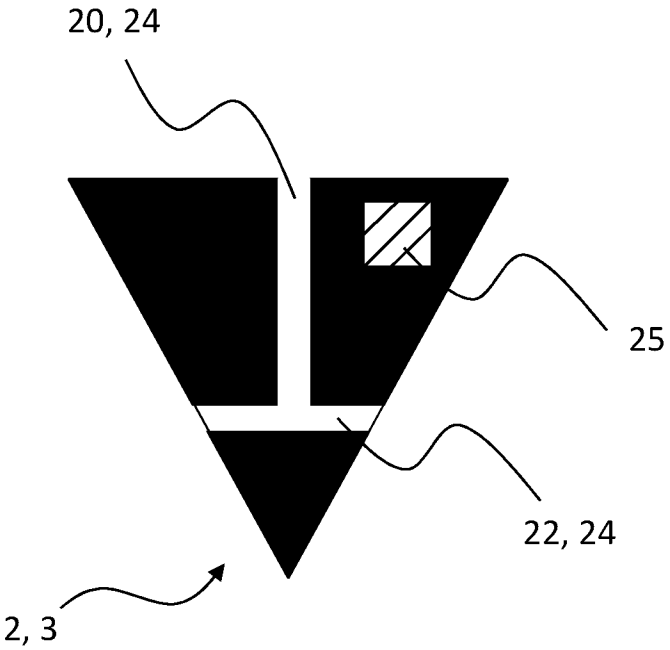
FIG. 3 shows a further functional marker such as can be used for various embodiments of a supply roll according to the invention.

FIG. 3 shows a further functional marker 2 or, as the case may be, adhesive marker 3 such as can be used for various embodiments of a supply roll 5 according to the invention (cf. FIG. 1). The functional marker 2 or, as the case may be, the adhesive marker 3 of the exemplary embodiment from FIG. 2 also has a mark 22, which assigns to the functional marker 2 or, as the case may be, to the adhesive marker 3 a specific rotary position with regard to the end edge 18 (cf. FIG. 1) of the externally arranged free end section 7. Just like the functional marker 2 or, as the case may be, the adhesive marker 3 of the exemplary embodiment from FIG. 2, the functional marker 2 or, as the case may be, the adhesive marker 3 in FIG. 3 also has a mark 20, which assigns to the functional marker 2 or, as the case may be, to the adhesive marker 3 a center position with regard to the longitudinal extension of the supply roll 5. By way of the mark 20 and with the help of the marking 16 (cf. FIG. 1), the functional marker 2 or, as the case may be, the adhesive marker 3 can be centrally aligned. The marks 20 and 22 are again each designed as transparent windows 24.

The functional marker 2 or, as the case may be, the adhesive marker 3 of the exemplary embodiment from FIG. 3 in addition has an RFID transponder 25 fixedly linked to the functional marker 2 or, as the case may be, to the adhesive marker 3. The RFID transponder 25 can have information stored on it about the particular supply roll 5, onto which the adhesive marker 3 is glued. In this instance it is conceivable that information, for example, on the number of windings, on the type of the particular flat material and/or strip material 8, on the amount of the longitudinal extension of the supply roll 5 and/or other information is stored on the RFID transponder 25. It is then possible to read the information from the RFID transponder 25 with an RFID reader, which is not illustrated in the figures of the present patent application, and which can be disposed in the area of an installation position EB (cf. FIG. 6), for example.

If information about the number of windings on the supply roll 5 is stored on the RFID transponder 25, it can be provided that a packaging machine is controlled in consideration of the stored information after reading it from the RFID transponder 25. In the instance of the number of windings having been stored, the packaging machine can indicate a necessary replacement of the supply roll 5, if applicable, or it can initiate a replacement of the almost completely depleted supply roll 5 or, as the case may be, it can carry out an automated replacement.

The embodiment from FIG. 3 with an RFID transponder 25 is to be understood by way of example. It can thus be provided that the functional marker 2 or, as the case may be, the adhesive marker 3 provides information via encodings about the supply roll 5 instead of the RFID transponder 25 or in addition to the RFID transponder 25. The encodings can be formed, for example, as QR code, barcode, and/or other encodings.

Figure 4:
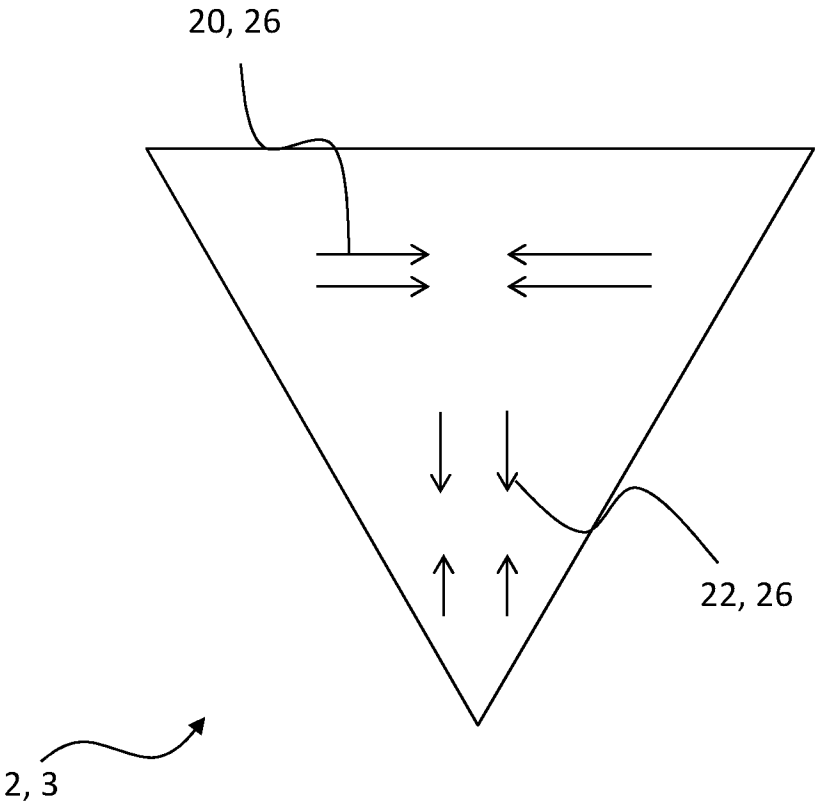
FIG. 4 shows a further functional marker such as can be used for various embodiments of a supply roll according to the invention.

It is also conceivable that the supply roll 5 forms a pocket in the free end section 7, in which pocket an RFID transponder 25 can be accommodated and fastened to the free end section 7. In these conceivable embodiments, the RFID transponder is not a component of the functional marker 2 or, as the case may be, of the adhesive marker 3. FIG. 4 shows a further functional marker 2 or, as the case may be, adhesive marker 3 such as can be used for various embodiments of a supply roll 5 according to the invention. The functional marker 2 or, as the case may be, the adhesive marker 3 is designed to be almost completely transparent and furthermore has marks 20 and 22 where a specified relative position of the functional marker 2 or, as the case may be, of the adhesive marker 3 at the free end section 7 of the flat material and/or strip material 8 is indicated. In the embodiment of a functional marker 2 or, as the case may be, of an adhesive marker 3 according to FIG. 4, the marks 20 and 22 are designed as arrow-based illustrations 26. Other symbols or, as the case may be, other designs can alternatively also be provided for the marks 20 and 22 in order to indicate the corresponding relative position for the functional marker 2 or, as the case may be, the adhesive marker 3 at the free end section 7 and, as required, its center alignment to the supply roll 5.

Figure 5:
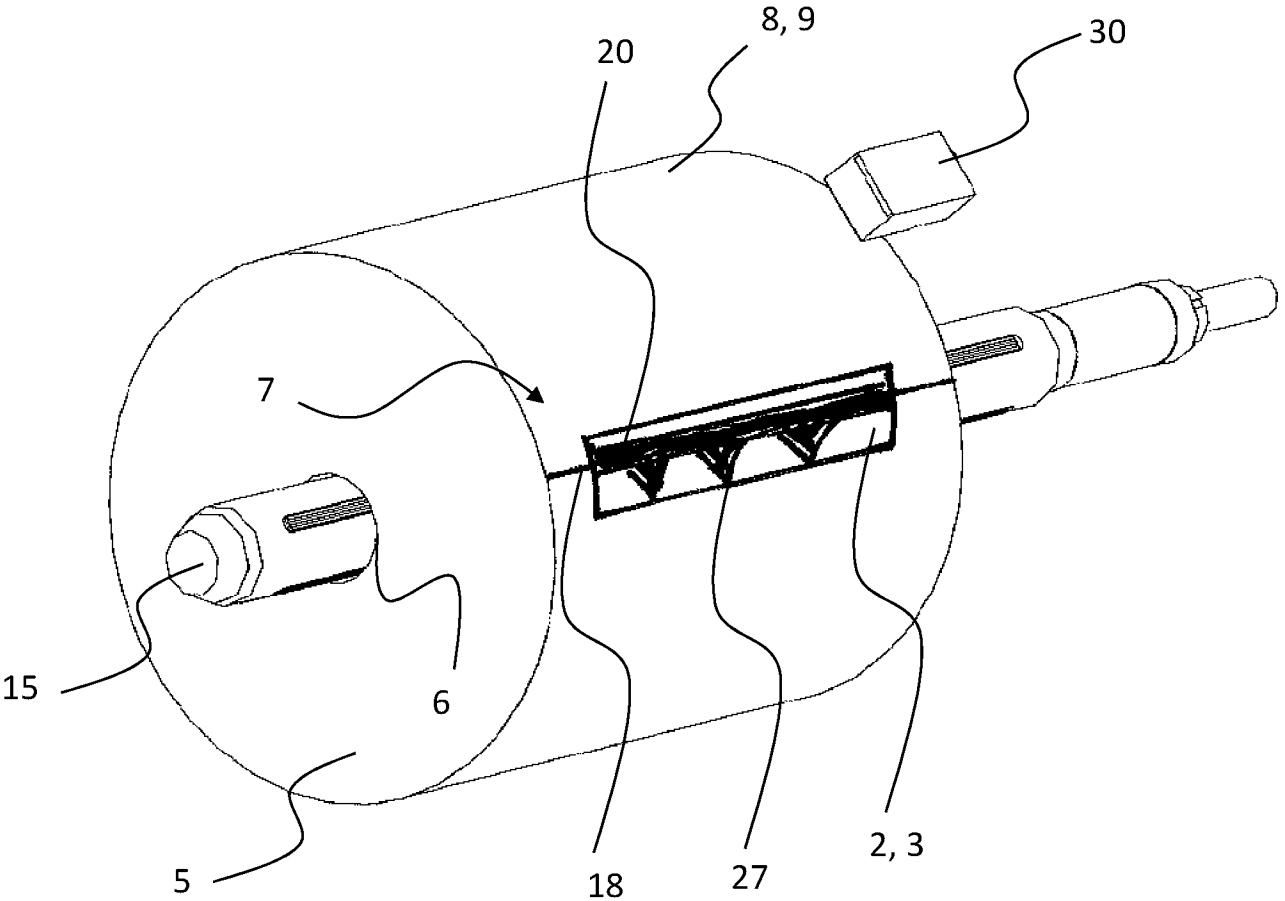
FIG. 5 shows a schematic view of a further embodiment of a supply roll according to the invention.

FIG. 5 shows a schematic view of a further embodiment of a supply roll 5 according to the invention. Just like the supply roll 5 from the exemplary embodiment in FIG. 1, the supply roll 5 of the exemplary embodiment from FIG. 5 also forms a free end section 7 with end edge 18. The flat material and/or strip material 8 of the supply roll 5 is shrink film 9. The flat material and/or strip material 8 is carried on a roll core 6, which is positioned on a retaining mandrel 15 of an installation position EB (cf. FIG. 6).

The functional marker 2 or, as the case may be, the adhesive marker 3 of FIG. 5 furthermore has a mark 20 extending along an end edge 18 of the free end section 7 or, as the case may be, of the flat material and/or strip material 8. The mark 20, the functional marker 2 or, as the case may be, the adhesive marker 3 can simply be applied or, as the case may be, glued in specified relative position onto the free end section 7 of the flat material and/or strip material 8. In the exemplary embodiment of FIG. 5, the free end section 7 is also fastened to an adjacent layer of the flat material and/or strip material 8 by way of the functional marker 2 or, as the case may be, by way of the adhesive marker 3, such that the free end section 7 is held substantially immovable to the supply roll 5 by way of the functional marker 2 or, as the case may be, by way of the adhesive marker 3. In contrast to the functional markers 2 or, as the case may be, to the adhesive markers 3 from the FIGS. 1 to 4, the functional marker 2 or, as the case may be, the adhesive marker 3 here has a plurality of triangular marks 27 positioned along the end edge 18 of the free end section 7. In conceivable further embodiments, the functional marker 2 or, as the case may be, the adhesive marker 3 can also extend with its triangular marks 27 over or, as the case may be, along the entire end edge 18.

Even with an inaccurate axial positioning of the supply roll 5 on the retaining mandrel 15 or, as the case may be, with an inaccurate axial alignment of the supply roll 5 in relation to the detection device 30, can the optical detection device 30 identify a particular position of the free end section 7 by way of the plurality of triangular marks 27. In the present instance, the triangular marks 27 are to be understood merely as an example, so that in various other embodiments it is also possible for other marks or, as the case may be, other symbols to be provided, so that the supply roll 5 or, as the case may be, the free end section 7 can be aligned with the help of the optical detection device 30.

Figure 6:
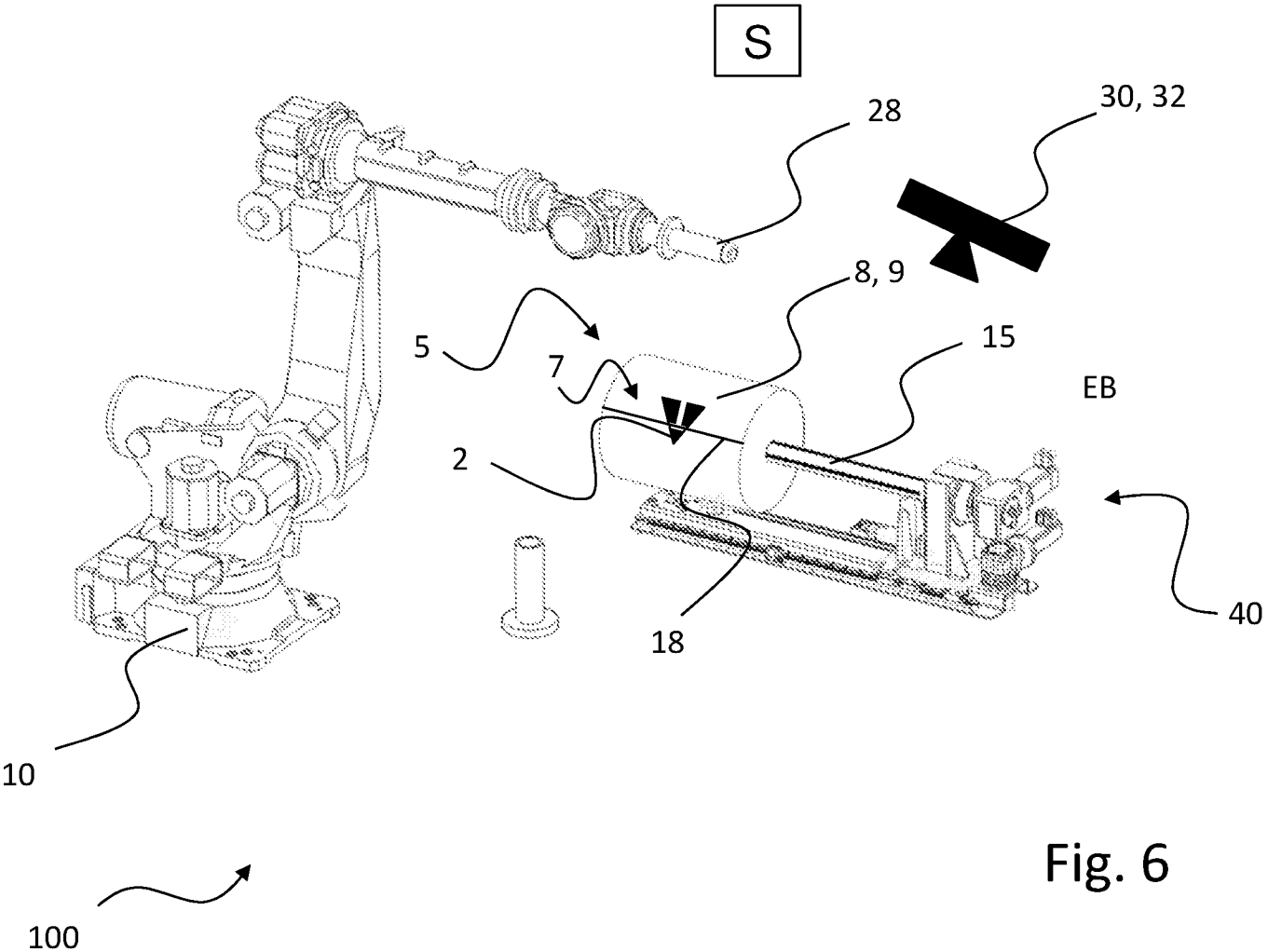
FIG. 6 shows a schematic view of an embodiment of an apparatus according to the invention.

FIG. 6 shows a schematic view of an embodiment of an apparatus or system 100 according to the invention. The apparatus 100 is provided for handling flat material and/or strip material 8 wound onto supply rolls 5.

The apparatus 100 comprises a device 50 (cf. FIG. 7), which is not illustrated in FIG. 5, and so that the functional marker 2 or, as the case may be, the adhesive marker 3 can be applied in specified relative position onto the externally arranged free end section 7 of the flat material and/or strip material 8 or, as the case may be, of the shrink film 9. The functional marker 2 or, as the case may be, the adhesive marker 3 in FIG. 5 is already linked to or, as the case may be, applied onto the externally arranged free end section 7.

Further discernible in FIG. 6 is an installation position EB for the rotating reception of the supply roll 5. For this purpose, a retaining mandrel 15, which can be splayed for clampingly holding the supply roll 5, is disposed in the installation position EB. The supply roll 5 is slid onto the retaining mandrel 15 by way of the handling device 10. The handling device 10 can take hold of the supply roll 5 by way of an own mandrel 28 and place the supply roll 5 on the retaining mandrel 15. The retaining mandrel 15 is linked to an actuator 40 or, as the case may be, the retaining mandrel 15 can be rotatingly moved by way of the actuator 40.

Furthermore, an optical detection device 30, for example possibly designed as camera system 32, is disposed in the area of the installation position EB. By way of the optical detection device 30, it is possible to identify a position of the functional marker 2 or, as the case may be, of the adhesive marker 3. The handling device 10, the actuator 40, and the optical detection device 30 or, as the case may be, the camera system 32 are linked to a control device S. When the position of the functional marker 2 or, as the case may be, of the adhesive marker 3 has been identified by the optical detection device 30 or, as the case may be, by the camera system 32, the control device S controls a rotating movement of the retaining mandrel 15, as the case may be, by way of the actuator 40 such that the functional marker 2 or, as the case may be, the adhesive marker 3 is hereby brought into a predefined desired position. A suction device and/or gripping device or, as the case may be, a suction rod, which is not illustrated in the Figures of the present patent application, can then take hold of and extract the free end section 7 of the supply roll 5. The flat material and/or strip material 8 or, as the case may be, the shrink film 9 of the supply roll 5 can subsequently be heat-sealed to a flat material and/or strip material or, as the case may be, to a shrink film of a further supply roll.

As shown in FIG. 3, the supply roll 5 or, as the case may be, the functional marker 2 can have an RFID transponder 25. At least one reader for the RFID transponder 25 can then be disposed in the area of the installation position EB and/or can be carried by the handling device 10.

Figure 7:
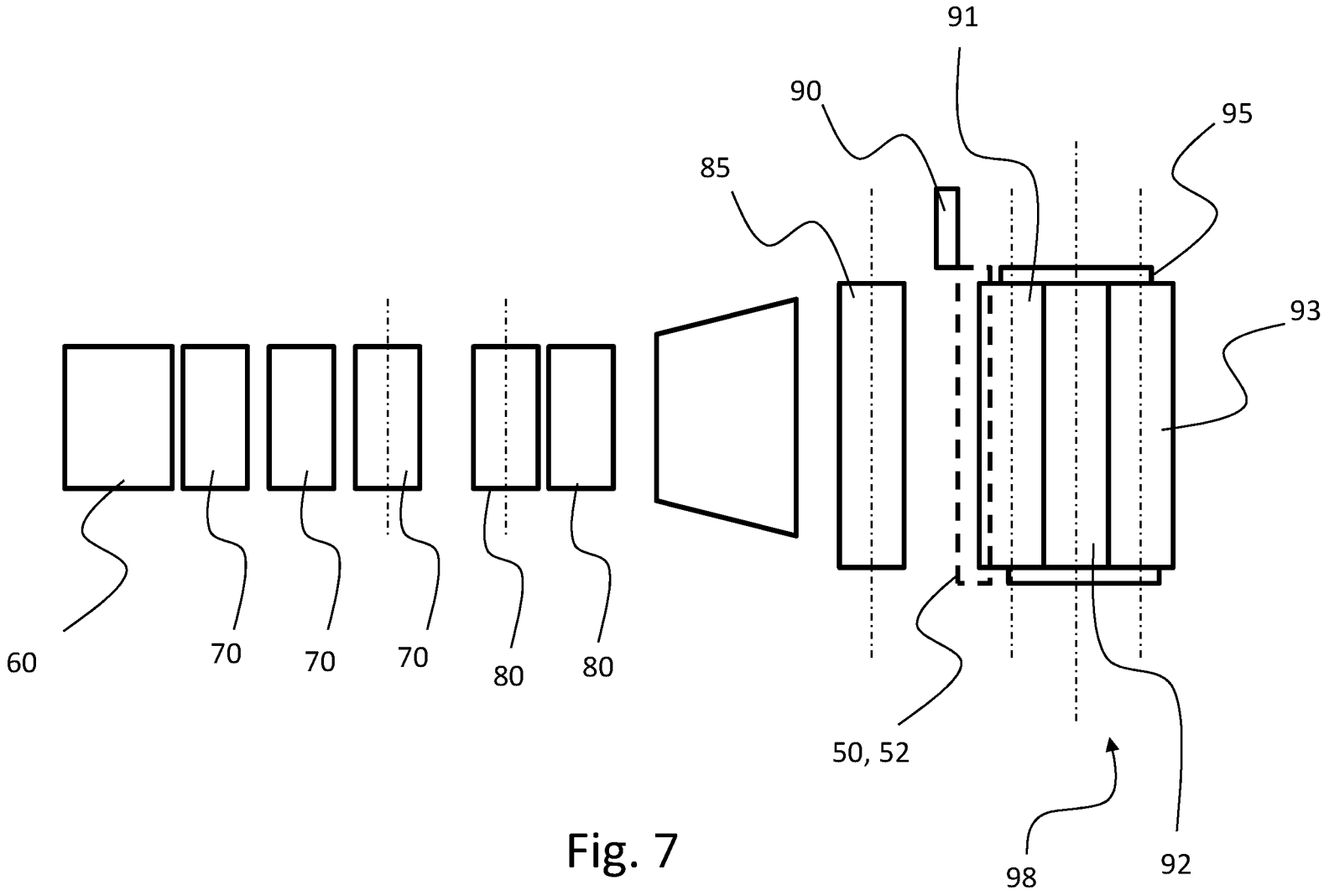
FIG. 7 illustrates steps such as can be part of the implementation of the method according to the invention and shows a plurality of devices or, as the case may be, stations such as can be designed as part of various embodiments of the apparatus according to the invention.

FIG. 7 illustrates steps such as can be part of the implementation of the method according to the invention and shows a plurality of devices or, as the case may be, stations such as can be designed as part of various embodiments of the apparatus 100 according to the invention.

Number 60 thus indicates an extruder with a plurality of rollers 70 and 80 disposed downstream in conveying direction from the extruder. Formed between the rollers 70 and 80 in conveying direction is a specific space, by way of which space the flat material and/or strip material 8 or, as the case may be, the shrink film 9 can be stretched in conveying direction. Number 85 indicates a contact roller, with an extending of the flat material and/or strip material 8 or, as the case may be, of the shrink film 9 being carried out in transverse direction between the contact roller 85 and the roller 80 that is last in conveying direction. After having passed the contact roller 85, the flat material and/or strip material 8 or, as the case may be, the shrink film 9 is guided further on to one of the winding rollers 91 to 93 by way of which the flat material and/or strip material 8 or, as the case may be, the shrink film 9 can be arranged on a roll core 6.

When the flat material and/or strip material 8 or, as the case may be, the shrink film 9 has been completely arranged on the roll core 6, a severing of the flat material and/or strip material 8 or, as the case may be, of the shrink film 9 is performed via the cutting device 90. The cutting device 90 can be, for example, a cutting knife, and it can emit a laser beam for the purpose of the particular severing process. The winding rollers 91 to 93 can in each case be exchanged by way of the rewind turret 95 such that the winding rollers 91 to 93 can be selectively staged in order to arrange flat material and/or strip material 8 or, as the case may be, shrink film 9 on a roll core 6 by one of the winding rollers 91 to 93.

The winding rollers 91 to 93 and the rewind turret 95 together form the winding apparatus 98. A device 50 is disposed in the area of the winding apparatus 98, where the device 50 can apply a functional marker 2 (cf. FIGS. 1 to 6) or, as the case may be, an adhesive marker 3 onto the free end section 7 of the flat material and/or strip material 8 or, as the case may be, of the shrink film 9. The device 50 is designed as printing station 52. In this context, a predefined relative position for the device 50 or, as the case may be, for the printing station 52 is provided in relation to the cutting device 90 and/or in relation to a contact element (not discernible in FIG. 7) for the flat material and/or strip material 8 or, as the case may be, for the shrink film 9 so that the functional marker 2 can be applied in specified relative position onto the free end section 7 of the flat material and/or strip material 8 or, as the case may be, of the shrink film 9. By way of the predefined relative position of the device 50 or, as the case may be, of the printing station 52 in relation to the cutting device 90 or, as the case may be, in relation to the winding apparatus 98, it is possible, even in the instance of a plurality of consecutive supply rolls 5, to apply the particular functional marker 2 onto the particular free end section 7 of the flat material and/or strip material 8 or, as the case may be, of the shrink film 9 with high precision and in a reproducible manner. Embodiments have proved particularly successful in which the device 50 or, as the case may be, the printing station 52 applies a particular functional marker 2 onto the flat material and/or strip material 8 or, as the case may be, onto the shrink film 9 temporally immediately prior to a severing process being effected by the cutting device 90 on the flat material and/or strip material 8 or, as the case may be, on the shrink film 9.

It should be additionally noted that the functional markers 2 or, as the case may be, the adhesive markers 3 can be equipped and used for transmitting and/or providing information and/or data about the film rolls 5 to a packaging machine and/or to a handling device 10. Other information carriers to be suitably used can be printed optical encodings or the mentioned RFID transponders 25.

The invention has been described with reference to a preferred embodiment. Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

LIST OF REFERENCE CHARACTERS

2 Functional marker
3 Adhesive marker
5 Supply roll
6 Roll core
7 Free end section
8 Flat material and/or strip material
9 Shrink film
10 Handling device
11 Externally arranged layer or adjacent layer
12 Holding block
14 Stop
15 Retaining mandrel
16 Marking
18 End edge
20 Second mark
22 First mark
24 Transparent window
25 RFID transponder
26 Arrow-based illustration
27 Triangular mark
28 Mandrel
30 Optical detection device
32 Camera system
40 Actuator
50 Device
52 Printing station
60 Extruder
70 Roller
80 Roller
85 Contact roller
90 Cutting device
91 Winding roller
92 Winding roller
93 Winding roller
95 Rewind turret
98 Winding apparatus
100 Apparatus
EB Installation position
S Control device

The invention claimed is:

1. A method for handling flat material and/or strip material (8) wound onto a supply roll (5), comprising:

applying at least one adhesive marker (3) in a position onto an externally arranged free end section (7) of the flat material and/or strip material (8) on a supply roll (5), wherein the at least one adhesive marker (3) comprises a transparent window (24) through which an end edge (18) of the externally arranged free end section (7) is visible;

positioning the supply roll (5) on a retaining mandrel (15);

optically identifying the position of the at least one functional marker (2);

aligning the free end section (7) based on the optical identification step; and extracting the free end section (7) from the supply roll (5).

2. The method of claim 1, wherein the supply roll (5)—comprises:

a roll core (6) and flat material and/or strip material (8) being carried on the roll core (6) in a multitude of windings; wherein the at least one adhesive marker (3) is placed in a position at an externally arranged free end section (7) of the flat material and/or strip material (8) such that information about the position of the free end section (7) is optically identifiable by way of the at least one adhesive marker (3).

3. The method of claim 1, wherein the at least one adhesive marker (3) comprises a plurality of adhesive markers (3).

4. The method of claim 1, wherein at least one adhesive marker (3) further comprises at least one second mark (20), which aligns the at least one adhesive marker (3) to a center position with regard to the longitudinal extension of the supply roll (5).

5. The method of claim 4 wherein the at least one second mark (20) is comprised by the transparent window (24).

6. The method of claim 1, comprising an RFID transponder (25).

7. The method of claim 6, wherein the RFID transponder (25) is a component of the at least one adhesive marker (3).

8. The method of claim 1, wherein the aligning step comprises rotating the supply roll (5) on the retaining mandrel (15).

9. The method of claim 8, wherein the applying step comprises applying the at least one adhesive marker (3) onto the externally arranged free end section (7) at least approximately centrally on the end edge (18).

10. The method of 9, with wherein the at least one adhesive marker (3) is attached to the free end section (7) and to a layer (11) of the flat material and/or strip material (8) adjacent to the free end section (7), such that the at least one adhesive marker (3) fastens the free end section (7) to the adjacent layer (11).

11. The method of claim 10, wherein a first adhesive bond between the free end section (7) and the adhesive marker (3) is stronger than a second adhesive bond between the adjacent layer (11) and the adhesive marker (3).

12. An apparatus (100) for handling flat material and/or strip material (8) wound onto supply rolls (5), the apparatus comprising:

a device (50) to apply at least one functional marker (2) in a position onto an externally arranged free end section (7) of the flat material and/or strip material (8) on a supply roll (5), wherein the at least one functional market (2) comprises a transparent window (24) through which an end edge (18) of the externally arranged free end section (7) is visible;

at least one installation position (EB) for the rotating reception of supply rolls (5) of flat material and/or film material (8);

a handling device (10) for mounting the particular supply roll (5) into the at least one installation position (EB);

an optical detection device (30) for identifying a position of the at least one functional marker (2); and one or more devices for aligning the free end section (7) of a particular supply roll (5) based on the optical detection such that the free end section (7) of a particular supply roll (5) in the installation position (EB) has a predefined position.

13. The apparatus of claim 12, wherein the device (50) comprising at least one printing station (52) for printing at least one functional marker (2) in a position onto the externally arranged free end section (7) of the flat material and/or strip material (8) on a particular supply roll (5).

* * * * *